US007232969B1

(12) United States Patent
Hsu et al.

(10) Patent No.: US 7,232,969 B1
(45) Date of Patent: Jun. 19, 2007

(54) KEYPAD

(75) Inventors: Ming-Yuan Hsu, Taipei County (TW); Chuan-Shien Yu, Taipei (TW)

(73) Assignee: Speed Tech Corp., Taoyuan (TW)

( * ) Notice: Subject to any disclaimer, the term of this patent is extended or adjusted under 35 U.S.C. 154(b) by 0 days.

(21) Appl. No.: 11/308,552

(22) Filed: Apr. 6, 2006

(51) Int. Cl.
*H01H 9/00* (2006.01)

(52) U.S. Cl. ..... 200/310; 200/314

(58) Field of Classification Search ..... 200/310–314, 200/341–345
See application file for complete search history.

(56) References Cited

U.S. PATENT DOCUMENTS 6,861,600 B1 * 3/2005 Schulz et al. ..... 200/310
6,911,608 B2 * 6/2005 Levy ..... 200/5 A
2003/0062519 A1 * 4/2003 Yamazaki et al. ..... 257/40
2004/0235279 A1 * 11/2004 Kim ..... 438/488
2005/0029631 A1 * 2/2005 Kim et al. ..... 257/640
2005/0185422 A1 * 8/2005 Henriet et al. ..... 362/615
2006/0012901 A1 * 1/2006 Shigemura et al. ..... 359/883
2006/0159945 A1 * 7/2006 Halik et al. ..... 428/537.5

* cited by examiner

*Primary Examiner*—K. Lee
*Assistant Examiner*—Lisa Klaus
(74) *Attorney, Agent, or Firm*—Jiang Chyun IP Office

(57) ABSTRACT

A keypad suitable for being disposed on a circuit board is provided. The keypad is in contact with the circuit board to generate an electrical signal. The keypad includes a flexible light guide plate, a key pattern, a passivation layer, a light source, and a reflector. Wherein, the key pattern and the passivation layer are both disposed on a first surface of the flexible light guide plate, and the passivation layer covers the key pattern. In addition, the light source and the reflector are both disposed at one side of the flexible light guide plate, and the reflector covers the light source. The keypad has better display brightness such that the user can easily recognize the patterns of the keys.

13 Claims, 4 Drawing Sheets

KEYPAD

BACKGROUND OF THE INVENTION

1. Field of the Invention

The present invention relates to a keypad, and more particularly, to a keypad with a flexible light guide plate.

2. Description of the Related Art

Along with the continuous technology development and the growth of the need for the convenience of portable products in the consumer market, the handheld electronic apparatus is designed to be lighter, thinner, shorter, and more compact and capable of providing powerful functions. In general, depending on the functions it provides, the handheld electronic apparatus are generally classified into cell phones, electronic dictionaries, Personal Digital Assistants (PDAs), and handheld game consoles.

For example, the cell phone mainly comprises a main body, a display unit, and a keypad. Wherein, the main body is usually a data processing module, and the display unit is usually a Liquid Crystal Display Module (LCM). The display unit is usually disposed inside the main body, and the display area of the display unit is exposed from the main body. The display unit displays the images, patterns, and the texts. In addition, the keypad usually disposed on the main body works as an operation interface of the handheld electronic apparatus.

To help users recognize the text or pattern on the keypad under a condition of insufficient luminance, a set of backing light source is commonly disposed under the keypad, such that the users can conveniently recognize the text or pattern on the keypad. In addition, the backing light source may be a Light Emitting Diode (LED) or an Electro-Luminescent Device (ELD). The detail structure of the conventional keypad is described in greater detail hereinafter.

FIG. 1 is a schematic sectional view of a conventional keypad. Referring to FIG. 1, the conventional keypad 100 comprises a first substrate 110, a second substrate 120, a key pattern, 130, a third substrate 140, and a light source 150 disposed on the third substrate 140. Wherein, the light source 150 is a Light Emitting Diode (LED). Since the light source 150 is disposed under the first substrate 110, the second substrate 120, and the key pattern 130. To be emitted from the surface of the second substrate 120, the light emitted by the light source 150 has to sequentially pass through the first substrate 110 and the second substrate 120. However, the first substrate 110 is usually made of a material such as PC (Phosphatidyl Cholineor) or ABS (Acrylonitrile Butadiene Styrene), and the second substrate 120 is usually made of a material such as rubber. In other words, the display brightness of the conventional keypad 100 is confined by the materials of the key pattern 130, the first substrate 110, and the second substrate 120. Accordingly, if the display brightness of the conventional keypad 100 is insufficient or not uniformly distributed, the user cannot easily recognize the text or pattern on the keypad. To resolve this problem, an easy solution is to increase the quantity of the light sources 150 disposed on the conventional keypad 100. However, such method inevitably increases electric power consumption of the handheld electronic apparatus.

In addition, although the keypad 100 provides more uniformly distributed brightness when it is comprised of the ELDs, since the ELDs are also disposed under the first substrate 110 and the second substrate 120, the light emitted by the ELDs is still confined by the first substrate 110 and the second substrate 120, the conventional keypad 100 is not able to provide an uniformly distributed brightness.

SUMMARY OF THE INVENTION

Therefore, it is an object of the present invention to provide a keypad that provides better display brightness.

To achieve the object mentioned above and others, a keypad suitable for being disposed on a circuit board is provided by the present invention. The keypad is brought into contact with the circuit board to generate an electrical signal. The keypad includes a flexible light guide plate, a key pattern, a passivation layer, a light source, and a reflector. Wherein, the key pattern and the passivation layer are both disposed on a first surface of the flexible light guide plate, and the passivation layer covers the key pattern. In addition, the light source and the reflector are both disposed at one side of the flexible light guide plate, and the reflector covers the light source.

In an embodiment of the present invention, the thickness of the flexible light guide plate is between 0.5–1.0 mm.

In an embodiment of the present invention, the flexible light guide plate is a wedge-shaped light guide plate. Wherein, a stuff material layer is further disposed between the wedge-shaped light guide plate and the circuit board, such that the wedge-shaped light guide plate can be flatly in contact with the circuit board.

In an embodiment of the present invention, the flexible light guide plate may be a parallel light guide plate.

In an embodiment of the present invention, the keypad further comprises an optical film that is disposed on a second surface of the flexible light guide plate. Wherein, the optical film may be a prism matrix-surfaced optical film. In addition, the keypad further comprises a reflector. The reflector is disposed on the second surface of the flexible light guide plate, and the optical film is disposed between the reflector and the flexible light guide plate.

In an embodiment of the present invention, the keypad further comprises a reflector, and the reflector is disposed on the second surface of the flexible light guide plate.

In an embodiment of the present invention, the passivation layer is made of a material such as transparent oxide metal or the transparent oxide semiconductor. Wherein, the transparent oxide metal may be silicon oxide or aluminum oxide.

In an embodiment of the present invention, the light source may be a Light Emitted Diode (LED) or a Cold Cathode Fluorescence Lamp (CCFL).

In an embodiment of the present invention, the shape of the reflector may be a semi-round shape or a semi-ellipse shape.

In summary, in the present invention, the light source is disposed at one side of the flexible light guide plate that has a light transparent property, and the key pattern is formed on the flexible light guide plate. Accordingly, the light emitted by the light source can sequentially pass through the flexible light guide plate and the key pattern and then enter into the user's eyes so as to improve the display brightness.

BRIEF DESCRIPTION DRAWINGS

The accompanying drawings are included to provide a further understanding of the invention, and are incorporated in and constitute a part of this specification. The drawings illustrate embodiments of the invention, and together with the description, serve to explain the principles of the invention.

FIGS. 3A~3E schematically shows a flow chart illustrating the steps of assembling the keypad according to the first embodiment of the present invention.

Figure 4:
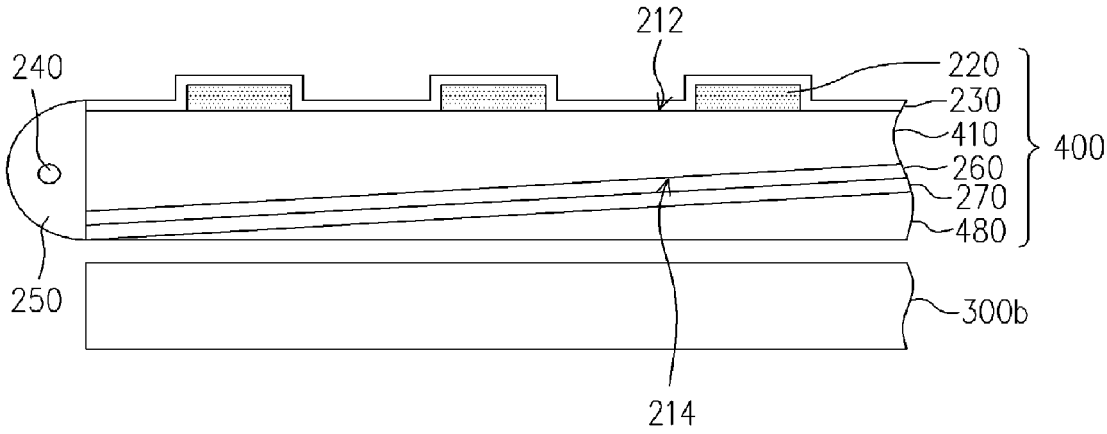

FIG. 4 is a schematic sectional view of a keypad according to a second embodiment of the present invention.

DESCRIPTION PREFERRED EMBODIMENTS

First Embodiment

Figure 1:
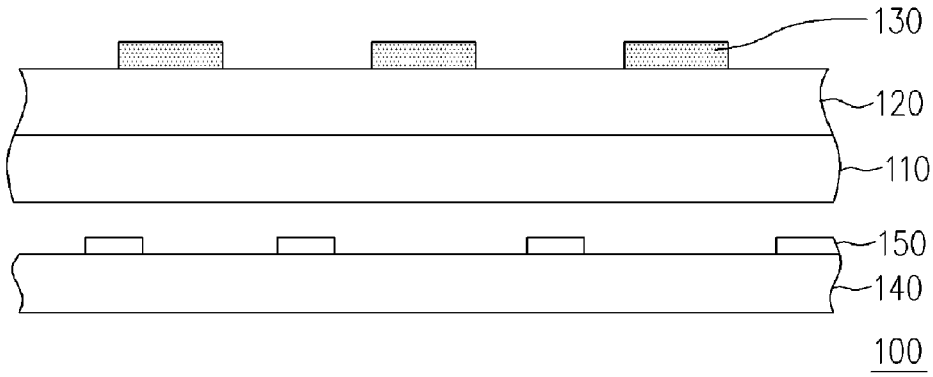
FIG. 1 (PRIOR ART)
FIG. 1 is a schematic sectional view of a conventional keypad.
Figure 2:
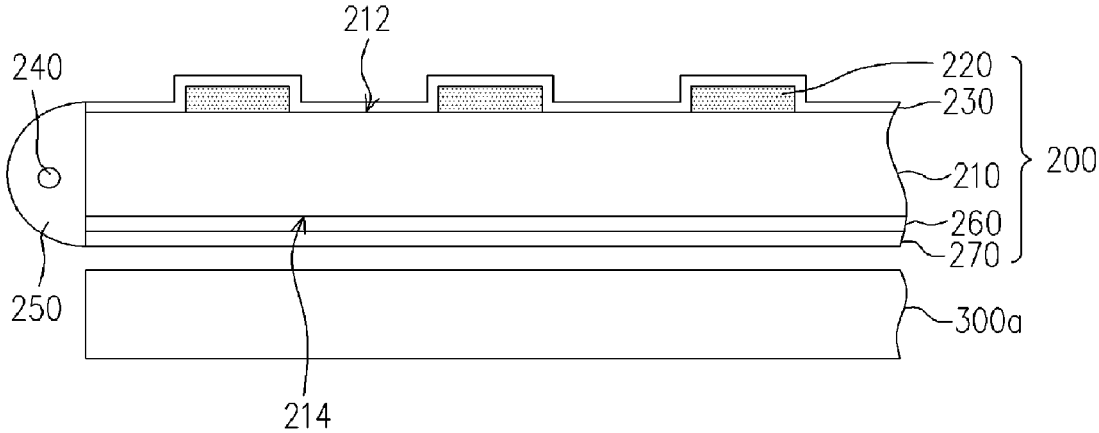
FIG. 2 is a schematic sectional view of a keypad according to a first embodiment of the present invention.

FIG. 2 is a schematic sectional view of a keypad according to a first embodiment of the present invention. Referring to FIG. 2, the keypad 200 is suitable for being disposed on a circuit board 300*a*. Wherein, the keypad 200 is suitable to be in contact with the circuit board 300*a*, such that the circuit board 300*a* can generate an electrical signal. The keypad 200 comprises a flexible light guide plate 210, a key pattern 220, a passivation layer 230, a light source 240, and a reflector 250. In the present embodiment, the flexible light guide plate 210 is a transparent and flexible parallel light guide plate with a thickness ranging between 0.5~1.0 mm.

In addition, the key pattern 220 is disposed on a first surface 212 of the flexible light guide plate 210. To avoid the problem of the user's failure to recognize the key pattern 220 because it is worn by the user's press, a passivation layer 230 is further disposed on the first surface 212 of the flexible light guide plate 210. The key pattern 220 is covered by the passivation layer 230. In the present embodiment, the passivation layer 230 is made of the transparent oxide metal or the transparent oxide semiconductor such as silicon oxide or aluminum oxide.

In the present embodiment, the light source 240 and the reflector 250 are both disposed at one side of the flexible light guide plate 210, and the light source 240 may be also disposed on both sides of the flexible light guide plate 210. In addition, the light source 240 may be a plurality of dot light sources composed of the LEDs or a CCFL line light source. Moreover, the reflector 250 covers the light source 240, and the shape of the reflector 250 may be a semi-round shape or a semi-ellipse shape, or a special curve capable of focusing the light source for improving the light utilization. Of course, as described above, to improve the display brightness of the keypad 200, the light source 240 may be disposed on both sides of the flexible light guide plate 210.

The key pattern 220 of the keypad 200 in the present embodiment is disposed on the flexible light guide plate 210, and the light source 240 is disposed at one side of the flexible light guide plate 210. Accordingly, after the light emitted by the light source 240 sequentially passes through the flexible light guide plate 210, the key pattern 220, and the transparent passivation layer 230, the light finally enters into the user's eyes. Comparing with the conventional keypad 100, since the light source 240 of the present embodiment is blocked by less materials, the keypad 200 can provide better display brightness to the users.

Once the keypad 200 can provide better display brightness, the key pattern 220 can be easily recognized by the users. When the user intends to input data into the handheld electronic apparatus (not shown), the user presses the key pattern 220. Meanwhile, since the flexible light guide plate 210 can be deformed in a great scale, the keypad 200 can easily be in contact with the circuit board 300*a*, such that the circuit board 300*a* can generate the corresponding electrical signal according to the key pattern 220 pressed by the user.

In the present embodiment, to improve the display brightness of the keypad 200, an optical film 260 is further disposed on a second surface 214 of the flexible light guide plate 210, and the light emitted by the light source 240 is uniformly distributed by the optical film 260. In the present embodiment, the optical film 260 may be a prism matrix-surfaced optical film. In addition, a reflector layer 270 is further disposed on the second surface 214 of the flexible light guide plate 210 in order to replace the optical film 260, and the reflector layer 270 is made of a material such as a reflective metal. Moreover, the optical film 260 and the reflector layer 270 may be further disposed on the second surface 214 of the flexible light guide plate 210 so as to improve the light utilization and the light uniformity of the keypad 200. Wherein, the optical film 260 is disposed between the reflector layer 270 and the flexible light guide plate 210. The fabricating method of the keypad 200 provided by the present embodiment is described in greater detail hereinafter.

Figure 3A:
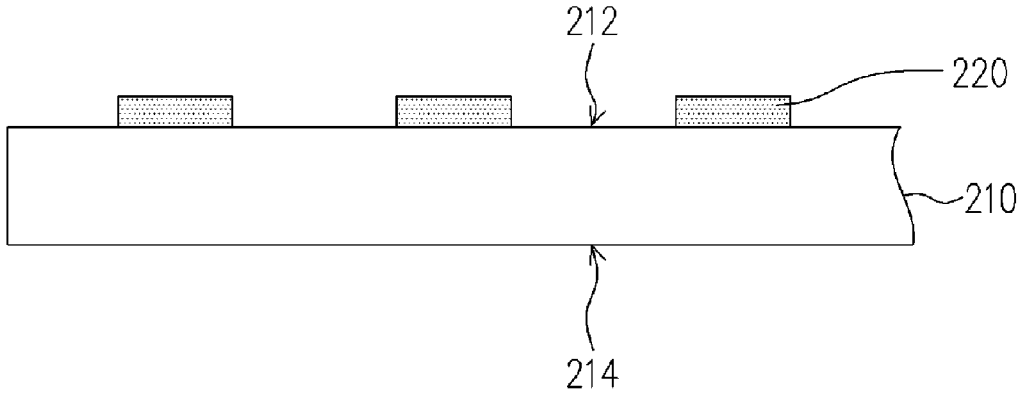

FIGS. 3A~3E schematically shows a flow chart illustrating the steps of assembling the keypad according to the first embodiment of the present invention. Referring to FIG. 3A, first a flexible light guide plate 210 is provided. Then, a key pattern 220 is formed on the first surface 212 of the flexible light guide plate 210. Wherein, the method for forming the key pattern 220 comprises a screen-printed process, a sputtering process, an evaporation coating process, or a mirror ink process.

Figure 3B:
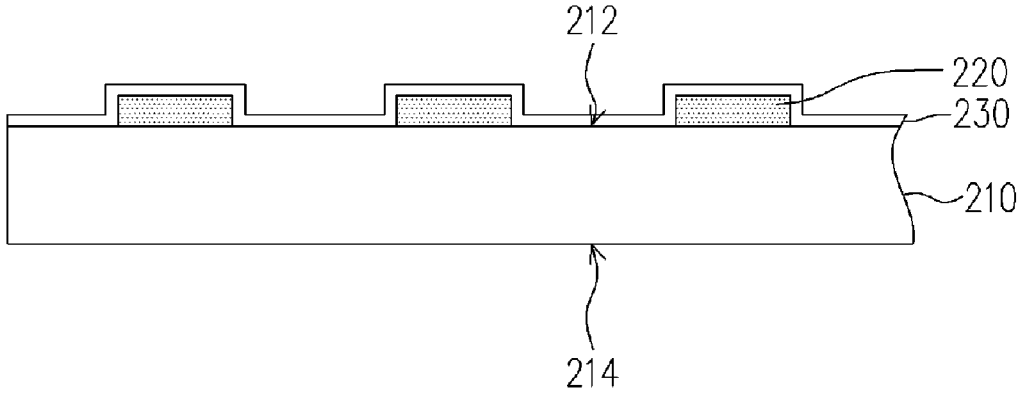

Referring to FIG. 3B, a passivation layer 230 is formed on the flexible light guide plate 210, and the passivation layer 230 covers the key pattern 220 for protecting the key pattern 220. In addition, the passivation layer 230 may be formed by the sputtering process. In other embodiments of the present invention, the passivation layer 230 may be formed by dipping the flexible light guide plate 210 with the key pattern 220 into liquor of the transparent oxide.

Figure 3C:
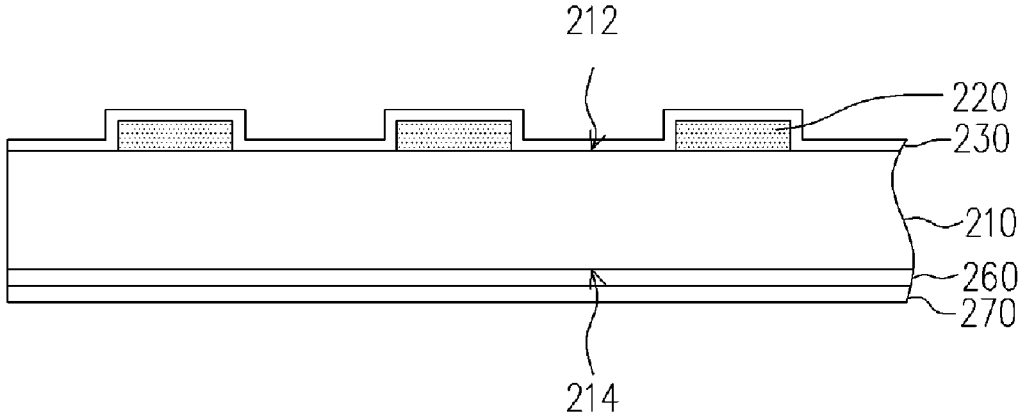

Referring to FIG. 3C, to improve the light utilization of the keypad, an optical film 260 may be further disposed on the second surface 214 of the flexible light guide plate 210, wherein the optical film 260 may be formed by the publishing process. Alternatively, the optical film 260 may be attached to the second surface 214 of the flexible light guide plate 210. Then, the reflector layer 270 is formed on the optical film 260, wherein the reflector layer 270 may be formed by the sputtering process. Similarly, the reflector layer 270 may be attached to the optical film 260. Moreover, the optical film 260 or the reflector layer 270 may be solely attached to the second surface 214 of the flexible light guide plate 210.

Figure 3D:
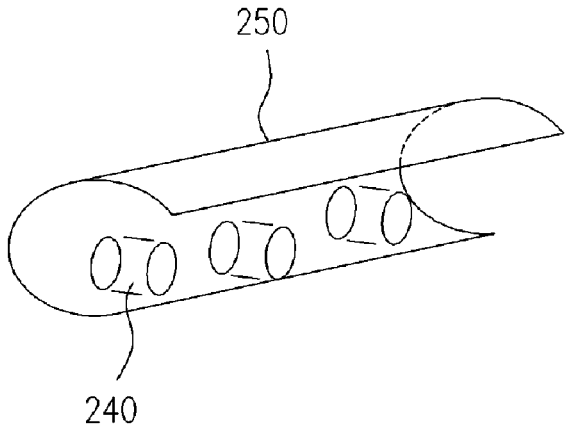

Referring to FIG. 3D, the light source 240 is assembled into a reflective mask 250. In the present embodiment, the light source 240 may be a plurality of dot light sources composed of the LEDs or a CCFL line light source.

Figure 3E:
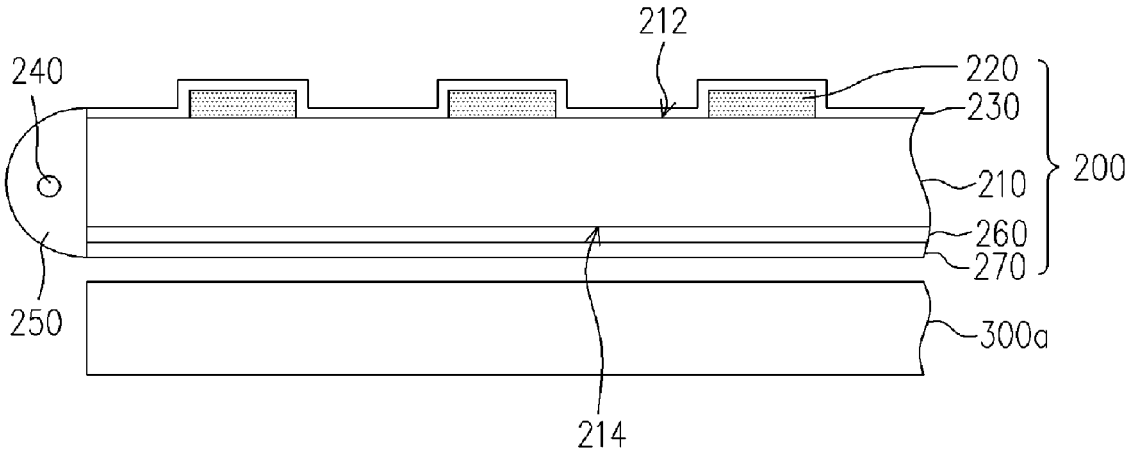

Referring to FIG. 3E, the reflective mask 250 with the light source 240 is assembled onto one side of the flexible light guide plate 210. Meanwhile, the other side of the flexible light guide plate 210 also can be assembled with the light source 240 and the reflector 250 (not shown) mentioned above in order to further improve the brightness and the uniformity of the emitting light. Finally, the assembly of the keypad 200 provided by the present invention is generally completed. Afterwards, the keypad 200 is assembled onto the circuit board 300*a*.

In the conventional keypad, before the light emitted by the light source enters into the user's eyes, the light must pass through the second substrate formed by ABS or PC and the first substrate formed by rubber. In the present invention, after the light emitted by the light source passes through the flexible light guide plate, the light can directly enter into the user's eyes. Accordingly, the keypad provided by the present invention can provide a better brightness to the user for recognizing the key pattern.

Second Embodiment

FIG. 4 is a schematic sectional view of a keypad according to a second embodiment of the present invention. Referring to FIGS. 2 and 4, the components and the assembly process of the second embodiment are generally the same as those of the first embodiment, and so do the disposed location and the functions of the components. Thus, the same components are marked with the same reference number, and its detail is omitted herein.

Referring to FIG. 4, the second embodiment differs the first embodiment in that the shape of the keypad 400 in the flexible light guide plate 410 provided by the present embodiment is different from that of the flexible light guide plate 210 in the first embodiment. In the second embodiment, the flexible light guide plate 410 is a wedge-shaped light guide plate. As the transmission path of the light emitted by the light source 240 is impacted by the slope of the bottom of the flexible light guide plate 410, the light is uniformly emitted from the surface of the flexible light guide plate 410.

In addition, to flatly bring the flexible light guide plate 410 into contact with the circuit board 300*b*, a stuff material layer 480 is further disposed between the flexible light guide plate 410 and the circuit board 300*b*. In the second embodiment, the stuff material layer 480 is disposed between the reflector layer 270 and the circuit board 300*b*, and the stuff material layer 408 is made of a material such as the flexible rubber. When the key pattern 220 is pressed by the user, the flexible light guide plate 410 deforms and presses against the stuff material layer 480, such that the stuff material layer 480 deforms and is in contact with the circuit board 300*b*. Then, a corresponding electrical signal is generated by the circuit board 300*b*. After the users stops pressing the key pattern 220, the stuff material layer 480 recovers to its original shape and height.

In summary, the keypad of the present invention at least has following advantages:

1. Comparing with the conventional technique where the second substrate is formed by the ABC or PC with poor light transparency and the first substrate formed by rubber, the present inventions uses the flexible light guide plate that may be a parallel light guide plate or a wedge-shaped light guide plate. After the light passes through the flexible light guide plate and the key pattern, the light can enter into the user's eyes. Compared with the conventional technique, the keypad of the present invention can provide better display brightness to the user.

2. In the present invention, an optical film and/or a reflector can be disposed below the flexible light guide plate. Wherein, the optical film and/or the reflector can uniformly distribute the light, such that the keypad can provide uniformly distributed display brightness.

Although the invention has been described with reference to a particular embodiment thereof, it will be apparent to one of the ordinary skills in the art that modifications to the described embodiment may be made without departing from the spirit of the invention. Accordingly, the scope of the invention will be defined by the appended claims not by the above detailed description.

What is claimed is:

1. A keypad suitable for being disposed on a circuit board, wherein the keypad is suitable to be in making contact with the circuit board to have the circuit board generate an electrical signal, the keypad comprises:

a flexible light guide plate;

a key pattern, disposed on a first surface of the flexible light guide plate;

a passivation layer, disposed on the first surface of the flexible light guide plate and covering the key pattern;

a light source, disposed at one side of the flexible light guide plate; and a reflector, covering the light source, wherein the reflector and the light source are both disposed on the same side of the flexible light guide plate.

2. The keypad of claim 1, wherein a thickness of the flexible light guide plate ranges between 0.5 to 1.0 mm.

3. The keypad of claim 1, wherein the flexible light guide plate is a wedge-shaped light guide plate.

4. The keypad of claim 3, further comprises a stuff material layer disposed between the flexible light guide plate and the circuit board.

5. The keypad of claim 1, wherein the flexible light guide plate is a parallel light guide plate.

6. The keypad of claim 1, further comprises an optical film disposed on a second surface of the flexible light guide plate.

7. The keypad of claim 6, wherein the optical film is a prism matrix-surfaced optical film.

8. The keypad of claim 6, further comprises a reflector layer disposed the second surface of the flexible light guide plate, and the optical film is disposed between the reflector layer and the flexible light guide plate.

9. The keypad of claim 1, further comprises a reflector layer disposed on the second surface of the flexible light guide plate.

10. The keypad of claim 1, wherein a material of the passivation layer is a transparent oxide metal or a transparent oxide semiconductor.

11. The keypad of claim 10, wherein the transparent oxide metal is one of silicon oxide and the aluminum oxide.

12. The keypad of claim 1, wherein the light source is a Light Emitted Diode (LED) or a Cold Cathode Fluorescence Lamp (CCFL).

13. The keypad of claim 1, wherein the shape of the reflective mask is a semi-round shape or a semi-ellipse shape.

* * * * *